United States Patent [19]

Biasini

[11] 4,312,490

[45] Jan. 26, 1982

[54] MUSIC STAND EXTENDER

[76] Inventor: Americole R. Biasini, 2101 Ontario St., Bellingham, Wash. 98225

[21] Appl. No.: 916,204

[22] Filed: Jun. 16, 1978

[51] Int. Cl.[3] ..... A47B 19/00

[52] U.S. Cl. ..... 248/542; 248/441 R

[58] Field of Search ..... 248/448, 542; 211/135, 211/175; 108/65, 69

[56] References Cited

U.S. PATENT DOCUMENTS

| | | | |
|---|---|---|---|
| 575,729 | 1/1897 | Palmer | 248/448 |
| 1,037,233 | 9/1912 | Furrow | 248/448 |
| 1,515,058 | 11/1924 | Lindhe | 211/50 |
| 1,542,495 | 6/1925 | Ebert | 211/51 |
| 1,651,471 | 12/1927 | Sawyer | 248/448 |
| 1,818,717 | 8/1931 | Kliegl | 248/448 |
| 1,959,843 | 5/1934 | Sprague | 248/448 |
| 2,538,318 | 1/1951 | Mitchell | 248/448 |
| 2,685,372 | 8/1954 | Palaith | 211/135 X |
| 3,021,637 | 2/1962 | Huffman | 248/441 R |
| 4,037,815 | 7/1977 | De Lano | 248/542 |

*Primary Examiner*—William H. Schultz

*Attorney, Agent, or Firm*—Hughes, Barnard & Cassidy

[57] ABSTRACT

A pair of extension members especially adapted to be slidably affixed to the book support member of a music stand of conventional construction. The extension panels comprise a back support panel and a lower support flange generally perpendicular thereto upon which may be supported sheet music. Each extension panel has provided thereon a plurality of retaining members, each defining a retaining groove which slidably engage the music stand. There is an upper retaining member defining an upper retaining groove which engages the upper horizontal edge portion of the back panel of a music stand, a first lower retaining member defining a first lower retaining groove which engages the support flange of a music stand, and a second lower retaining member defining a second lower retaining groove which engages the lower horizontal edge portion of the back panel of a music stand. There is an indicating means to indicate full extension of the extension panels. In a second embodiment, a pair of extension members adapted to be affixed to a folding music stand, the members have an "L" shaped cross-sectional configuration with a generally horizontally aligned portion and a generally vertically aligned portion affixed thereto. Each member has a pivot end and a swing end, the member pivoting about the pivot end from a non-extended to an extended operative position.

4 Claims, 7 Drawing Figures

FIG. 3
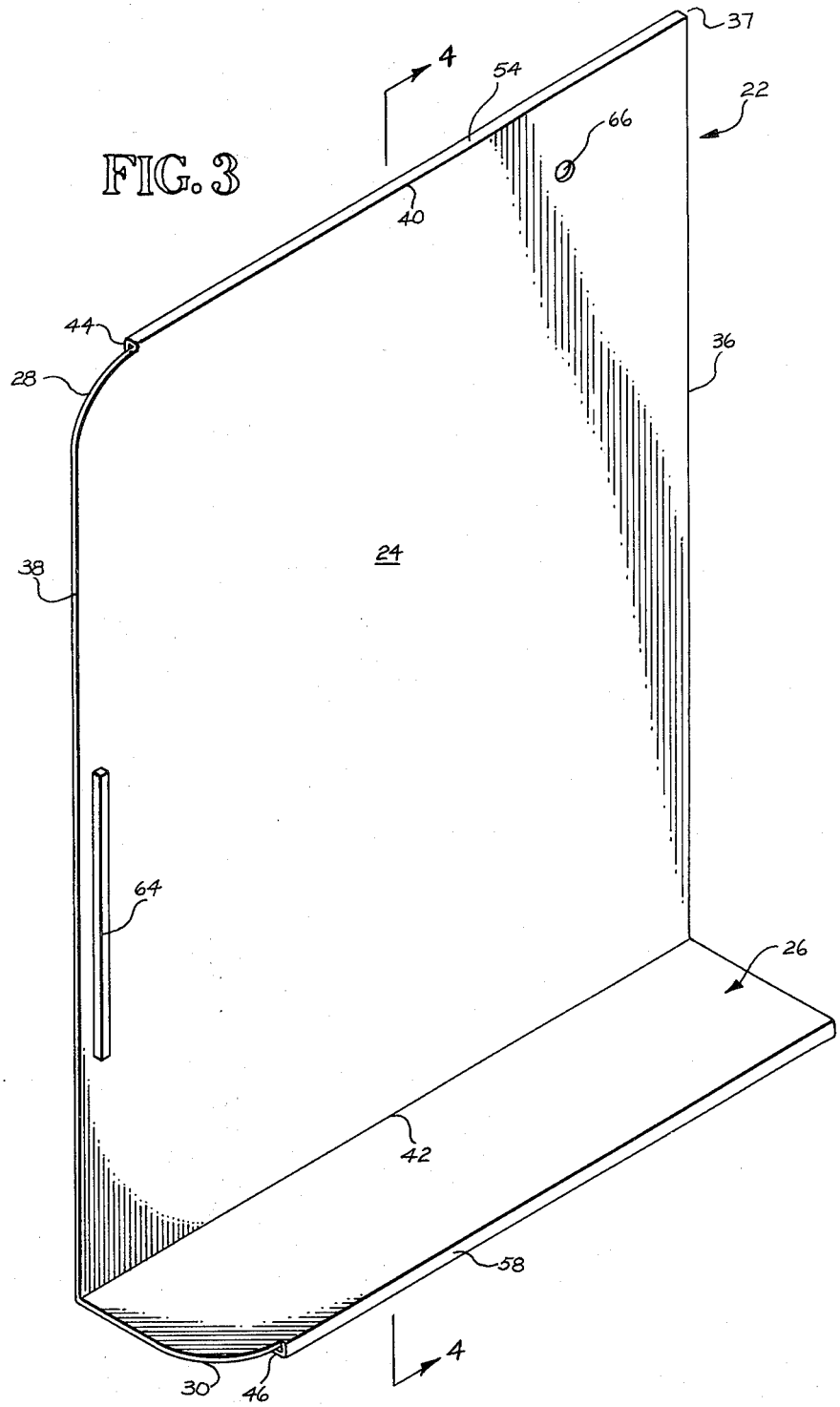
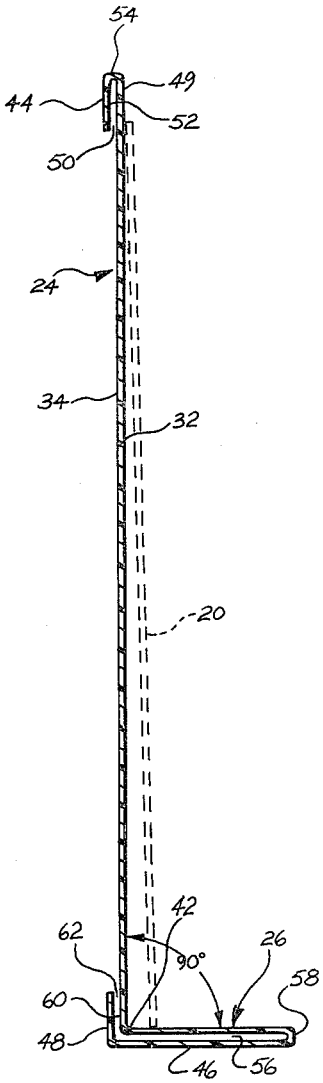
FIG. 4

FIG. 5
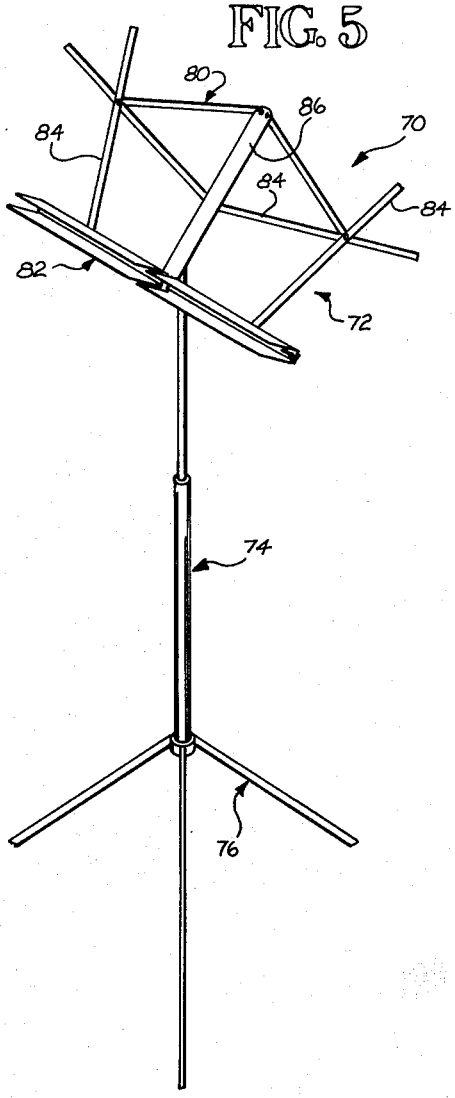
FIG. 6
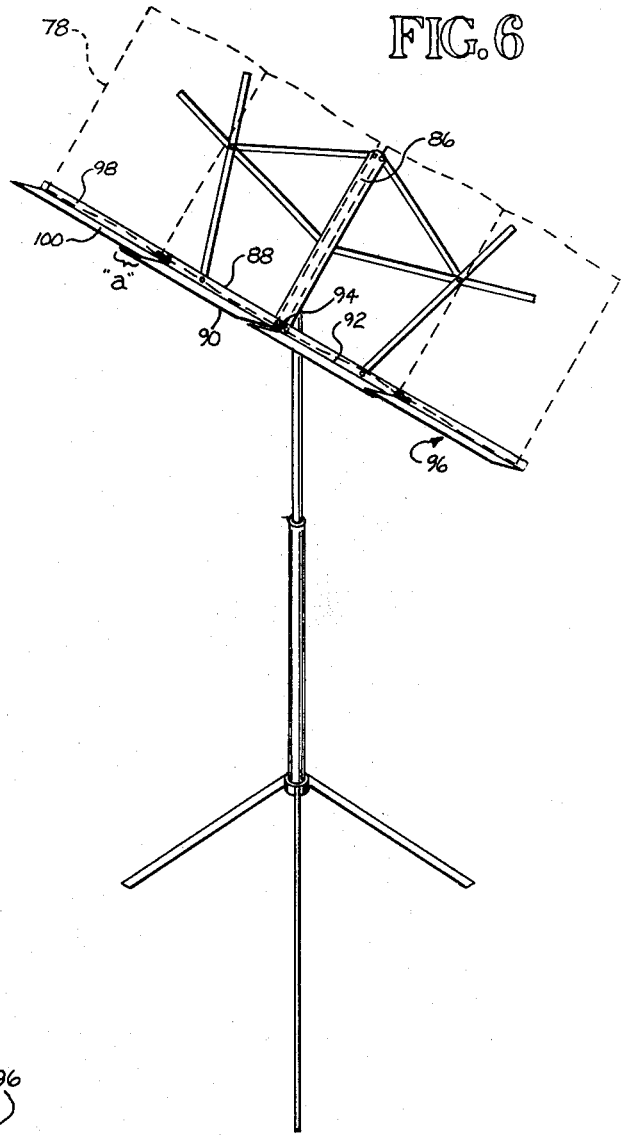
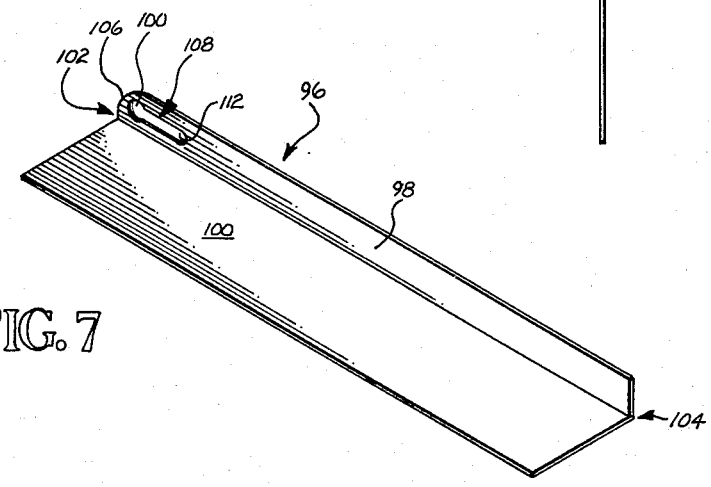
FIG. 7

MUSIC STAND EXTENDER

BACKGROUND OF THE INVENTION

I. Field of the Invention

The present invention relates to music stands, and more particularly to extension wings which may be affixed to a conventional music stand.

II. Description of the Prior Art

Musicians who must perform from sheet music have been confronted with the problem of using music stands which have been constructed for holding a single book of sheet music, so that when it is necessary to utilize two or more books of music, or an overly large book of music, one must place two music stands side by side in order to accommodate the material. This results in a maze of music stands, often in an orchestra or other situation where there is very little available space, as well as the need for a large number of music stands, often at considerable expense. Thus, there is the need for a device which will provide an enlarged support area for sheet music, while at the same time taking advantage of the large number of conventional music stands now in use.

One type of extensible music stand is shown in the prior art in U.S. Pat. No. 1,818,717, Kleigl, which illustrates a stand having an adjustable music rest which normally provides space for a single sheet of music, but which may be expanded nominally beyond that width when the necessity arises. The back plate of the music rest has its side and lower edges turned upwardly, which forms an enclosed box-like area with the hooded lamp which comprises the upper edge. The forward, upward edge of each wall is turned in the form of a bead to enclose and grip a portion of a circular wire or rod, which is bent in two directions to provide a horizontal plunger-like portion which enters the bead. This permits the side walls to be moved horizontally to and from the sides of the music rack.

U.S. Pat. No. 1,037,233, Furrow, illustrates another music-desk construction for attachment to a pianoforte. The adjustable desk is composed of three panels, a center panel and two side panels attached thereto. Lateral tongues in the side panels interfit with a dove-tailed groove in the center panel which allow the side panels to be adjusted laterally to increase the width of the desk. The assembly is provided with a plurality of lugs and brackets which attach the desk to a pianoforte.

As other examples of the prior art, U.S. Pat. No. 2,538,318, Mitchell, illustrates a copy holder which may be adjusted to accommodate sheets of different widths. There is a fixed section to the copyholder which has a flange on one side and lower and upper flanges, each with inwardly extending ribs forming a guide. The adjustable section slides over the back of the fixed section and is provided with flanges which slide in the open end of the guideway of the flanges on the fixed section. The adjustable section is retained in adjustable position by a detent in a rib provided on the fixed section. The lower flanges of the fixed and adjustable sections provide means to hold a copy on the two sections when the copyholder is in its expanded or unexpanded position. The width of the copyholder is increased by simply pulling the adjustable section laterally and sliding it within the guides provided by the flanges of the fixed section. The copyholder is also provided with a plurality of adjustable legs.

U.S. Pat. Nos. 1,452,495, Ebert, and 1,515,058, Lindhe, disclose adjustable racks for holding pamphlets or sheets of paper. In each case there is a back plate upon which laterally move a pair of extension arms, one to the left and one to the right. There may also be vertically extensible members in addition to the laterally extensible arms. Flanges at the outermost end of each arm retain the material to be held thereon.

U.S. Pat. No. 1,651,741, Sawyer, illustrates a device to maintain a large card in a flat or substantially flat condition, wherein a strip or bar of sheet metal has its longitudinal edges inturned such that the inturned edges interfit in sliding relationship with a coupler which is secured to a base plate. Any number of the sheet metal extenders may be connected one to another by using the couplers to provide a card holder of any appropriate size.

U.S. Pat. Nos. 3,021,637, Huffman, and 1,959,843, Sprague, are further examples of prior art supporting devices.

While all of these devices may function as described, there is a need for an apparatus which may be purchased separately for addition to an existing music stand, thereby avoiding the expense of purchasing additional complete music stands.

SUMMARY

In the present invention, these is an extension device adapted to be engaged with a music stand of conventional construction to enlarge the surface contact support area of the music stand. The extension device is adapted to slidably engage the music stand and overlie the vertically aligned back support panel and the horizontally aligned support panel of the music stand.

The extension device has a planar panel portion which is positioned against a surface of the back support panel, a lower flange portion which is positioned against a surface of the support panel of the music stand, and a plurality of retaining flanges. The upper retaining flange defines an upper retaining groove which interfits with the upper portion of the music stand. A first lower retaining flange defines a lower horizontal retaining groove and receives the music stand support flange. A second lower retaining flange defines a lower vertical retaining groove which receives a lower portion of the music stand back support panel. There is a retracted position wherein the planar panel portion overlies the back support panel and an extended position where the extension members are moved laterally outwardly to enlarge the support surface of the music stand.

In a second embodiment of the present invention the extension device is adapted to interfit with a folding music stand of conventional construction. The device has an "L" shaped cross-sectional configuration, and is pivotally mounted to the base support member of said folding music stand. In an extended position, the extension device overlaps the base support member of the folding music stand to limit further pivoting motion therebetween. In the retracted position, the music stand may be folded to its stowed position with the extension device affixed thereto.

BRIEF DESCRIPTION OF THE DRAWINGS

FIG. 3 is an isometric view illustrating detail of a single extension panel of the present invention;

FIG. 4 is a sectional view taken along line 4—4 of FIG. 3;

FIG. 5 is an isometric view, similar to FIG. 1, of a folding music stand with a second embodiment of the extension member of the present invention in the non-extended position;

FIG. 6 is an isometric view of the extension members of a second embodiment of the present invention in the extended position in place on a folding music stand, and FIG. 7 is an isometric view of the extension member of the present invention for a folding music stand.

DESCRIPTION OF THE PREFERRED EMBODIMENT

Figure 1:
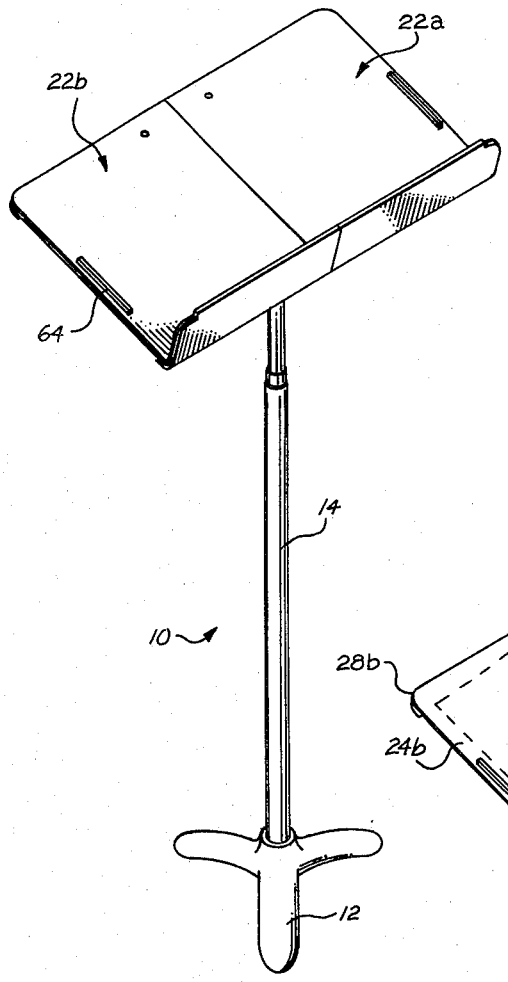
FIG. 1 is an isometric view illustrating the extension panels of the present invention in place in the non-extended position on a conventional music stand.
Figure 2:
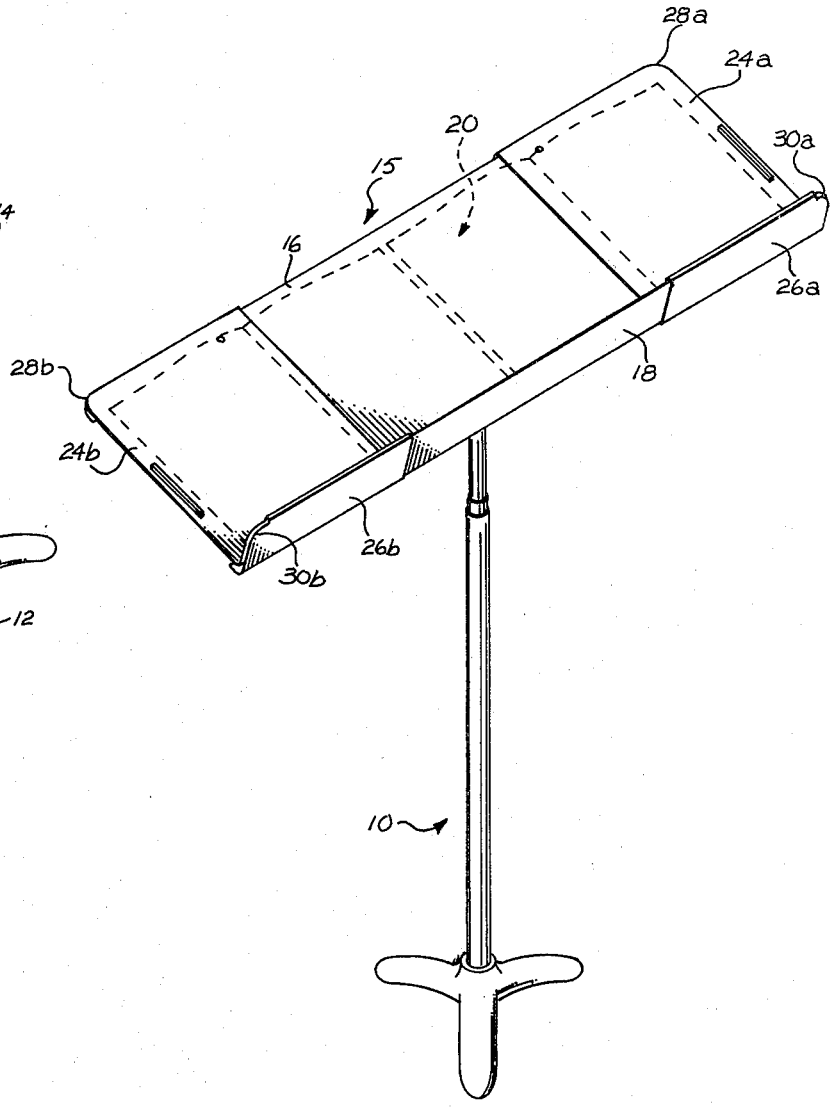
FIG. 2 is an isometric view of the extension panels of the present invention in the extended position in place on a conventional music stand.

As shown in FIGS. 1 and 2, there is a music stand 10 as it would appear during use for holding sheet music or a book of music from which a musician would read during a performance. This music stand 10 comprises a base 12, a telescoping pedestal 14, and a book support member 15, which includes a back support panel 16 and a lower support flange 18 generally perpendicular to the back panel 16. In a conventional music stand, there is an adjustable fitting (not shown herein) interconnecting the back support panel 16 and the pedestal 14 which allows the musician to adjust the angle of the back panel 16 from a near-vertical position rearwardly to a near-horizontal position. The support flange 18 is positioned to prevent the sheet music 20 from sliding downwardly from the music stand 10.

The conventional music stand, such as the Manhasset Music Stand manufactured by King Musical Instrument Company, has a back panel 16 typically about 20 inches in width and approximately twelve and three-quarters inches high, made of relatively thin guage (typically one-eighth inch in thickness) rolled metal stock.

The present invention is embodied in a pair of detachable extension wings 22 which are designed to be used as an addition to the music stand 10 described above. The extension wings 22*a* and 22*b*, as shown in FIGS. 1 and 2, have the same general shape as the music stand book support member 15, with a back support panel 24 and a lower support flange 26. The method of attachment of extension wings 22*a* and 22*b* to the music stand 10 will be discussed hereinafter.

The extension wings 22 as envisioned herein may be conveniently manufactured from a single mold, and then shaped to fit either the right or left facing side of the music stand 10. As shown in FIGS. 1–3, the wings 22 have been finished as mirror images of each other and shaped with rounded outer corner edges 28 and 30 for safety purposes, as well as to fit the underlying shape of the music stand 10. For greater simplicity and fewer manufacturing steps, the wings 22 could be manufactured and utilized without finishing the corners, resulting in identical wings 22.

With the increasing popularity of avante garde electronic music and jazz music, both of which may have a musical score printed on oversized music books or sheets of music which may open to widths of as much as thirty-six inches, or in pamphlets which fold out serially into a booklet four or more pages in width, it is very difficult to maintain all of the pages on a standard width music stand without portions hanging off either or both of the left or right sides. Also, when two musicians are playing or singing a duet, there may be different musical scores for each, necessitating two music books and two music stands. The present invention will alleviate many of these problems by increasing the support area of the back panel 16 from approximately twenty inches to approximately thirty-six inches, as a simple addition onto existing music stands.

As illustrated in broken lines in FIG. 2, a music book 20 opened to four pages in width would be impossible to support on a conventional music stand, and would necessitate the musician interrupting his performance in order to turn the pages. With the addition of the present invention, this same music book is easily held in fully opened position using the same music stand.

It is to be understood that, while FIGS. 3 and 4, and the descriptive material hereinafter, are phrased in the singular, this description will apply equally well to both extension wings as depicted in FIGS. 1 and 2.

The extension wing 22 has a back support panel 24, having a front side 32 and a back side 34, bounded by two parallel side edges 36 and 38, a top edge 40 and a lower junction line 42 where the panel 24 joins the lower support flange 26. The "inner" side edge 36 (in that it abuts the adjacent side edge of a mated extension wing in the closed position of FIG. 1) is provided with a right angled upper corner 37 at its juncture with the top edge 40. The "outer" side edge 38 has the rounded upper corner 28 with the top edge 40 so that it will perfectly overlie the upper corner of a conventional music stand 10.

The extension wing 22 may be formed in any conventional manner, such as being molded from an extrusion process initially into its final configuration, or being provided initially as a single enlarged back panel 24 which is thereafter deformed to produce the end configuration of the extension wing 22. The lower support flange 26 is generally provided at approximately a ninety degree angle to the lower edge of the back panel 24, so that a book or sheet of music 20 will be retained against the back panel 24 and supported by the support flange 26.

There are provided a plurality of retaining members, in the form of three retaining flanges 44, 46 and 48, which slidably attach the wing 22 to the back panel 16 and support flange 18 of the music stand 10. There is an upper retaining flange 44 which defines with the upper portion 49 of the back panel 24 an upper retaining groove 50 which receives the upper edge portion of the back panel 16 of the music stand 10. This groove 50 is defined by the back surface 34 of the upper portion of the back panel 24 and a forward surface 52 of the flange 44. The upper retaining flange 44 is connected to the back panel 24 by a joining member 54, extending along and closely adjacent to the upper edge of the back panel 24.

The resulting upper retaining groove 50 is provided with a width dimension between the upper retaining flange 44 and the back panel 24 of the same approximate thickness as that of the back panel 16 of the music stand 10, so that the groove 50 receives in frictional engagement the upper edge portion of the back panel 16.

The support flange 26 of the wing 22 in the preferred configuration is formed integrally with the second and third retaining flanges 46 and 48. The second retaining flange 46 is positioned parallel to and immediately below the support flange 26 and defines therewith a lower horizontal retaining groove 56 which receives therein the lower support flange 18 of the stand 10. The flange 46 is connected to the support flange 26 by a joining member 58, extending along the forward edge of the support panel 26. The width dimension of the second retaining groove 56 is of the same approximate thickness as that of the support flange 18 of the music stand 10, so that the flanges 26 and 46 will frictionally engage the flange 18.

The third retaining flange 48 is attached to and extends upwardly from the rear edge of the retaining flange 46 and defines with the lower portion 60 of the back panel 24 a third retaining groove 62. The third retaining groove 60 has a width dimension substantially equal to the width dimension of the upper retaining groove 50.

The extension wings 22 may be interfitted to the music stand 10 by simply sliding the book support member 15 into the retaining grooves 50, 56, and 62. When the wings 22 have been affixed to a music stand 10, and increased support surface is not required, the wing 22 may be left in the closed position of FIG. 1. However, if the need arises for greater support surface, one or both wings 22 may be pulled to the expanded position of FIG. 2 by pulling outwardly on the rib 64.

If the wings 22 are made of an opaque or translucent material, there may be sight holes 66 provided to prevent the user from accidentally pulling the wings 22 out of engagement with the music stand 10. These holes 66 are conveniently placed approximately two inches from the inner edge 36 of the wing 22, so that when one can see through the hole 66 and beyond, there is approximately two inches of each of the flanges 44, 46, and 48 still frictionally engaged with the book support member 16, which has been found to be sufficient to support most music books and sheets.

In a second embodiment of the present invention shown in FIGS. 5–7, there is a folding music stand 70 similar to the Hamilton folding music stand, in its open operative position. This music stand 70 comprises a foldable upper music support portion 72, a telescoping pedestal 74, and a foldable leg portion 76. The upper portion 72 supports music (shown in broken lines at 78) in the form of elongate sheet music or books of music, and comprises a back support portion 80 and a base support portion 82. The back support 80 is provided as a plurality of pivotally interconnected arms 84, some of which are connected to a vertically aligned center back support 86.

The base support 82 supports the music 78 and comprises generally a vertically aligned lip portion 88 and a horizontally aligned flange portion 90 connected at 92 and approximately perpendicular to one another. In the folding music stand 70 the base support member 82 is made as two sections which are pivotally attached at 94 to the center back support 86 and which in the operative position of FIGS. 5 and 6 are aligned end-to-end.

The music stand 70 folds into a compact position (not shown herein) for convenient transport or storage. The two sections of the base support member 82 pivot toward one another about the pivot point 94 and the arms 84 fold inwardly toward the center support 86.

The present invention is provided as a base support extension member 96 for attachment onto the conventional folding music stand 70. The extension members 96 are constructed with a generally "L" shaped cross-sectional configuration, having a generally vertically aligned portion 98 and a generally horizontally aligned portion 100 affixed to one another at a right angle. The member 96 has a pivot end 102 and a swing end 104, the pivot end 102 having a curved upper corner portion 106 to facilitate pivotal movement of the member 96, and also having an aperture 108 therethrough.

The aperture 108 defines the pivot point of the extension member 96, and is provided in a keyhole-shaped configuration with an enlarged portion 110 and an elongate engaging portion 112. There is an attaching member mounting the member 96 to the base support 82 through the aperture 108. The attaching member may be a rivet or bolt having an enlarged head and a shaft diameter of a size to pivot freely within the enlarged portion 50 of the aperture 108, but which will frictionally engage the elongate portion 112 of the aperture 108.

The width dimensions of the horizontal and vertical portions of the extension members 96 correspond generally to those of the base support 82, and are approximately eight to ten inches in length, so that the base support area of the music stand can be increased from approximately sixteen inches to approximately thirty inches in width when the members 96 are in their extended position. With the advent of avante garde music and the increasing popularity of jazz music, both of which are typically provided in oversized expanding music sheets or large music books, the increased support area is crucial if the folding music stand is to be utilized.

The aperture 108 and attaching member are so positioned that when the extension members 96 are fully extended, there is an overlap of approximately one to two inches between the pivot end 102 of the member 96 and the outer end of the base support member 82 affixed thereto. This overlap, designated "a" in FIG. 6, limits further pivotal movement of the extension member 96 and provides a stop or catch to hold the member 96 in a horizontal position.

In operation, a musician or music department which has previously purchased one or more folding music stands as shown in FIGS. 5 and 6, need only purchase a pair of extension members 96 for each stand, drill a hole in the vertically aligned portion 88 of the base support 82 at the appropriate location, and attach the extension member 96 with a rivet, bolt, or other attaching member. Once attached, the extension member 96 will pivot about the attaching member within the enlarged portion 110 of the aperture 108 to the expanded position shown in FIG. 6. Once expanded, to lock the extension member securely in place, it need only be gently pushed inwardly so that the attaching member firmly engages the smaller elongate portion 112 of the aperture 108.

If it is desired to use the music stand 70 without having the extension members 96 extended, they may be returned to the retracted position of FIG. 5, whereupon the bottom side of the horizontal portion 100 of the extension member 96 will face upwardly and serve as a base upon which to support music sheets or books.

When the stand 70 is to be folded and stored, the extension member 96 may be pivoted back to the closed position and the base support members 82 may be easily folded to the stored position. In this folded position, the extension members 96 will not interfere with the folding of the music stand 70.

What is claimed is:

1. An extension device adapted to enlarge the surface contact support area of a music stand, said music stand having a generally vertically aligned back support panel having a front side and a back side and a generally horizontally aligned support flange affixed to a lower edge portion of said back support panel, said support flange having an upper side and a lower side, said extension device being adapted to slidably engage music stands of conventional construction without requiring structural changes thereto or additional attaching members thereon, said extension device comprising:

a. a planar panel portion having an upper edge and a lower edge, said panel portion being adapted to be positioned against a surface of said back support panel with the upper edge of the panel portion being closely adjacent an upper edge of the back support panel, and with the lower edge of the panel portion being positioned closely adjacent a lower edge of said back support panel, b. a flange portion adapted to be positioned against a surface of said music stand support flange, said flange portion having a rear edge connected to the lower edge of the panel portion and a forward edge, c. an upper retaining flange connected to the upper edge of the panel portion and extending downwardly therefrom to define with an upper portion of said panel portion an upper vertical retaining groove to receive an upper vertical portion of the music stand support panel in frictional engagement, d. a first lower retaining flange connected to the forward edge of the flange portion and extending rearwardly therefrom to define with the flange portion a lower horizontal retaining groove to receive said music stand support flange in frictional engagement, e. said extension device having a retracted position where said panel portion overlies said back support panel and an extended position where inner portions of the extension device overlap outer portions of said music stand back support panel and said music stand support flange to provide support for said extension device, whereby, said extension device may be retained in said retracted position when an enlarged surface area is unnecessary for conventional music sheets or books, and said device may be moved to said extended position to enlarge the support surface when oversized sheets or books of music are to be used, said extension device permitting a musician to utilize a single music stand instead of two or more music stands.

2. The member as recited in claim 1, wherein said extension device further comprises a second lower retaining flange, said second lower retaining flange connected to the rearward edge portion of said first lower retaining flange and extending upwardly therefrom to define with a lower portion of said panel portion a lower vertical retaining groove to receive a lower vertical portion of the music stand support panel in frictional engagement.

3. The member as recited in claim 1, wherein said panel portion is provided with indicating means, said panel portion defining a sight hole indicating full extension of said extension device.

4. The member as recited in claim 1, wherein said upper and lower retaining flanges frictionally engage said music stand back support panel and flange in said extended position, said flanges preventing forward or rearward pivotal movement of said device.

* * * * *